US006896211B2

(12) United States Patent
Seitz

(10) Patent No.: US 6,896,211 B2
(45) Date of Patent: May 24, 2005

(54) METHOD AND APPARATUS FOR REDUCING COATING BUILDUP ON FEED TUBES

(75) Inventor: David M. Seitz, Riga, MI (US)

(73) Assignee: Illinois Tool Works Inc., Glenview, IL (US)

( * ) Notice: Subject to any disclaimer, the term of this patent is extended or adjusted under 35 U.S.C. 154(b) by 247 days.

(21) Appl. No.: 10/229,678

(22) Filed: Aug. 28, 2002

(65) Prior Publication Data

US 2003/0080221 A1 May 1, 2003

Related U.S. Application Data

(60) Provisional application No. 60/335,195, filed on Oct. 31, 2001.

(51) Int. Cl.[7] ..... B05B 5/04
(52) U.S. Cl. ..... 239/700; 239/703
(58) Field of Search ..... 239/223, 224, 239/3, 708, 700–704

(56) References Cited

U.S. PATENT DOCUMENTS

| | | | | |
|---|---|---|---|---|
| 4,943,005 | A | 7/1990 | Weinstein | |
| 5,433,387 | A | 7/1995 | Howe et al. | |
| 5,620,750 | A | 4/1997 | Minoura et al. | |
| 5,622,563 | A | 4/1997 | Howe et al. | |
| 5,662,278 | A | 9/1997 | Howe et al. | |
| 6,076,751 | A | 6/2000 | Austin et al. | |
| 6,230,993 | B1 | 5/2001 | Austin et al. | |
| 6,409,104 | B1 * | 6/2002 | Fiala et al. | 239/703 |

FOREIGN PATENT DOCUMENTS

| | | |
|---|---|---|
| EP | 0 803 293 | 10/1997 |
| EP | 0 818 243 | 1/1998 |
| JP | 08 024721 | 1/1996 |
| JP | 09 094488 | 4/1997 |

* cited by examiner

*Primary Examiner*—Gene Mancene
*Assistant Examiner*—Thach H. Bui
(74) *Attorney, Agent, or Firm*—Barnes & Thornburg LLP

(57) ABSTRACT

A bell cup includes an interior defined by an axially rearward metal back region, an axially forward metal discharge edge, and a metal side region extending from the back region toward the discharge edge and terminating at the discharge edge. The back region includes a port having a forward end through which coating material to be atomized is supplied to the interior, and a metal intermediate portion between the forward end and the side region. The intermediate portion is oriented axially further away from the discharge edge than the forward end is axially from the discharge edge.

38 Claims, 3 Drawing Sheets

METHOD AND APPARATUS FOR REDUCING COATING BUILDUP ON FEED TUBES

CROSS-REFERENCE TO RELATED APPLICATIONS

Priority is claimed under 35 U.S.C. § 119(e) to U.S. Provisional Patent Application Ser. No. 60/335,195 filed Oct. 31, 2001, the disclosure of which is hereby incorporated herein by reference.

FIELD OF THE INVENTION

The present invention relates to atomizers used in electrostatic coating systems and particularly, to atomizers having rotating bell cups and feed tubes that deliver liquid coating material to the bell cups. More particularly, the present invention relates to methods and apparatus for reducing coating buildup on feed tubes of rotary atomizers.

BACKGROUND OF THE INVENTION

Electrostatic coating systems having bell cups that rotate at high speeds to atomize liquid coating material are known. In some electrostatic coating systems, liquid coating material is fed onto an inner surface of the rotating bell cup through a feed tube that extends along the axis of rotation of the bell cup. Forces created by the rotating bell cup act on the liquid coating material causing a film of coating material to be formed over the inner surface of the bell cup. The film of coating material flows along the inner surface of the bell cup toward a forward, discharge edge of the bell cup and a voltage source electrostatically charges the flowing film of coating material. At the discharge edge of the rotating bell cup, the film of coating material is discharged as an electrostatically charged mist which is directed toward an oppositely-charged object to be coated.

It is desirable for electrostatic coating systems to apply an even coating of material to the objects being coated. However, in some conventional electrostatic coating systems, clumps of partially dried coating material build up on the end of the feed tube adjacent the rotating bell cup. From time to time, the built up paint drops from the end of the feed tube onto the rotating bell cup and is flung onto an object being coated and creating a defect in the coating which needs to be buffed, or otherwise removed from, the object during rework operations performed subsequent to the coating process. It is therefore, desirable to reduce paint buildup on the ends of feed tubes of rotary atomizers.

DISCLOSURE OF THE INVENTION

According to one aspect of the invention, a rotary atomizer includes a shaft rotatable about an axis and a bell cup coupled to the shaft. The shaft has a passageway extending longitudinally along it. The bell cup has an interior defined by an axially rearward metal back region, an axially forward metal discharge edge, and a metal side region extending from the back region toward the discharge edge and terminating at the discharge edge. The back region includes a port having a forward end. The back region includes an intermediate portion between the forward end and the side region. The intermediate portion is oriented axially further away from the discharge edge than the forward end is axially from the discharge edge. A feed tube is oriented in the passageway and has a discharge end through which liquid coating material is discharged.

Illustratively according to this aspect of the invention, the back region, discharge edge and side region are all constructed from the same metal.

Illustratively according to this aspect of the invention, the metal back region, metal discharge edge and metal side region are all aluminum.

Alternatively illustratively according to this aspect of the invention, the metal back region, metal discharge edge and metal side region are all titanium.

Illustratively according to this aspect of the invention, the discharge end is oriented axially forward of the intermediate portion.

Alternatively illustratively according to this aspect of the invention, the discharge end is substantially coplanar with the forward end.

Illustratively according to this aspect of the invention, the port includes a somewhat frustoconical surface having a base oriented adjacent the intermediate portion.

Further illustratively according to this aspect of the invention, the apparatus includes a high-magnitude potential supply coupled to the rotary atomizer for providing electrical charge to coating material discharged from the discharge edge.

According to another aspect of the invention, a bell cup is provided for attachment to the shaft of a rotator to be rotated by the rotator to atomize coating material supplied to an interior of the bell cup. The bell cup includes an interior defined by an axially rearward metal back region, an axially forward metal discharge edge, and a metal side region extending from the back region toward the discharge edge and terminating at the discharge edge. The back region includes a port having a forward end through which coating material to be atomized is supplied to the interior. The back region includes an intermediate portion between the forward end and the side region. The intermediate portion is oriented axially further away from the discharge edge than the forward end is axially from the discharge edge.

Illustratively according to this aspect of the invention, the back region, discharge edge and side region are all constructed from the same metal.

Illustratively according to this aspect of the invention, the metal back region, metal discharge edge and metal side region are all aluminum.

Alternatively illustratively according to this aspect of the invention, the metal back region, metal discharge edge and metal side region are titanium.

Further illustratively according to this aspect of the invention, a feed tube is provided for supplying coating material to the interior. The feed tube has a discharge end substantially coplanar with the forward end. Liquid coating material is discharged through the discharge end.

According to another aspect of the invention, a method of atomizing coating material includes providing a bell cup having an interior defined by an axially rearward metal back region, an axially forward metal discharge edge, and a metal side region extending from the back region toward the discharge edge and terminating at the discharge edge. The back region includes a port having a forward end. The back region includes an intermediate portion between the forward end and the side region. The intermediate portion is oriented axially further away from the discharge edge than the forward end is axially from the discharge edge. The method further includes rotating the bell cup about a rotational axis and feeding liquid coating material to the port.

Illustratively according to this aspect of the invention, providing a bell cup having an interior defined by an axially rearward metal back region, an axially forward metal discharge edge, and a metal side region includes providing a bell cup having an interior defined by an axially rearward back region, an axially forward discharge edge, and a side region, all of the same metal.

Illustratively according to this aspect of the invention, providing a bell cup having an interior defined by an axially rearward metal back region, an axially forward metal discharge edge, and a metal side region includes providing a bell cup having an interior defined by an axially rearward aluminum back region, an axially forward aluminum discharge edge, and an aluminum side region.

Alternatively illustratively according to this aspect of the invention, providing a bell cup having an interior defined by an axially rearward metal back region, an axially forward metal discharge edge, and a metal side region includes providing a bell cup having an interior defined by an axially rearward titaninum back region, an axially forward titaninum discharge edge, and a titaninum side region.

Illustratively according to this aspect of the invention, feeding liquid coating material to the port includes feeding liquid coating material to the forward end.

Illustratively according to this aspect of the invention, providing a back region including a port having a forward end includes providing a bell cup having a somewhat frustoconical surface having a base oriented adjacent the intermediate portion.

Further illustratively according to this aspect of the invention, the method includes providing electrical charge to coating material discharged from the discharge edge.

According to another aspect of the invention, a method of atomizing coating material includes providing a rotator having an output shaft rotatable about an axis, providing a passageway extending longitudinally along the shaft and coupling a bell cup to the shaft. An interior is defined in the bell cup. The interior has an axially rearward metal back region including a port having a forward end, an axially forward metal discharge edge, and a metal side region extending from the back region toward the discharge edge and terminating at the discharge edge. A metal intermediate portion is provided on the back region between the forward end and the side region. The metal intermediate portion is oriented axially further away from the discharge edge than the forward end is axially from the discharge edge. A feed tube is provided in the passageway. The feed tube terminates at a discharge end substantially coplanar with the forward end. Liquid coating material is discharged through the discharge end.

Illustratively according to this aspect of the invention, defining in the bell cup an interior having a metal back region, a metal discharge edge, and a metal side region, and providing on the back region a metal intermediate portion includes defining in the bell cup an interior having a back region, a discharge edge, and a side region, and providing on the back region an intermediate portion, all of the same metal.

Illustratively according to this aspect of the invention, defining in the bell cup an interior having a metal back region, a metal discharge edge, and a metal side region, and providing on the back region a metal intermediate portion between the forward end and the side region includes defining in the bell cup an interior having an aluminum back region, an aluminum discharge edge, and an aluminum side region, and providing on the back region an aluminum intermediate portion.

Alternatively illustratively according to this aspect of the invention, defining in the bell cup an interior having a metal back region, a metal discharge edge, and a metal side region, and providing on the back region a metal intermediate portion between the forward end and the side region includes defining in the bell cup an interior having a titaninum back region, a titaninum discharge edge, and a titaninum side region, and providing on the back region a titaninum intermediate portion.

Illustratively according to this aspect of the invention, defining in the bell cup an interior having an axially rearward back region including a port having a forward end and an intermediate portion between the forward end and the side region and oriented axially further away from the discharge edge than the forward end includes providing a somewhat frustoconical surface having a base oriented adjacent the intermediate portion.

Further illustratively according to this aspect of the invention, the method includes providing electrical charge to coating material discharged from the discharge edge.

According to another aspect of the invention, a method of dispensing coating material includes providing a bell cup having an axis of rotation, rotating the bell cup about its axis, and feeding coating material to the forward end. The bell cup has an interior including an axially rearward metal back region, an axially forward metal discharge edge, and a metal side region extending from the back region toward the discharge edge and terminating at the discharge edge. The back region includes a port having a forward end through which coating material to be atomized is supplied to the interior. The back region includes a metal intermediate portion between the forward end and the side region and oriented axially further away from the discharge edge than the forward end is axially from the discharge edge.

Illustratively according to this aspect of the invention, defining in the bell cup a metal back region, a metal discharge edge and a metal side region, and including in the back region a metal intermediate portion includes defining in the bell cup a back region, a discharge edge, and a side region and including in the back region an intermediate portion, all of the same metal.

Illustratively according to this aspect of the invention, defining in the bell cup a metal back region, a metal discharge edge and a metal side region, and including in the back region a metal intermediate portion includes defining in the bell cup an aluminum back region, an aluminum discharge edge and an aluminum side region, and including in the back region an aluminum intermediate portion.

Alternatively illustratively according to this aspect of the invention, defining in the bell cup a metal back region, a metal discharge edge and a metal side region, and including in the back region a metal intermediate portion includes defining in the bell cup a titaninum back region, a titaninum discharge edge and a titaninum side region, and including in the back region a titaninum intermediate portion.

Illustratively according to this aspect of the invention, feeding coating material to the forward end includes feeding coating material through a feed tube having a discharge end substantially coplanar with the forward end, and discharging the liquid coating material through the discharge end.

Further illustratively according to this aspect of the invention, the method includes providing electrical charge to coating material discharged from the discharge edge.

According to another aspect of the invention, apparatus for atomizing coating material includes bell cup means, means for rotating the bell cup means about a rotational axis and means for feeding liquid coating material to the port. The bell cup means define an interior including an axially rearward metal back region, an axially forward metal discharge edge, and a metal side region extending from the back region toward the discharge edge and terminating at the discharge edge. The back region includes a port having a forward end. The back region includes a metal intermediate portion between the forward end and the side region. The intermediate portion is oriented axially further away from the discharge edge than the forward end is axially from the discharge edge.

According to another aspect of the invention, apparatus for atomizing coating material includes bell cup means, means for rotating the bell cup means about its axis and means for coupling the bell cup means to the means for rotating the bell cup means. The bell cup means defines an interior having an axially rearward metal back region including a port having a forward end, an axially forward metal discharge edge, a metal side region extending from the back region toward the discharge edge and terminating at the discharge edge, and a metal intermediate portion between the forward end and the side region and oriented axially further away from the discharge edge than the forward end is axially from the discharge edge. The means for rotating the bell cup means has an output shaft rotatable about an axis. The means for coupling the bell cup means to the means for rotating the bell cup means includes the output shaft. The output shaft has a passageway extending longitudinally along the output shaft. Means are provided in the passageway for supplying coating material to the interior. The means for supplying coating material terminates at a discharge end substantially coplanar with the forward end.

According to another aspect of the invention, apparatus for dispensing coating material includes bell cup means, means for rotating the bell cup about its axis, and means for feeding coating material to the forward end. The bell cup means defines an axis of rotation and an interior including an axially rearward metal back region, an axially forward metal discharge edge, and a metal side region extending from the back region toward the discharge edge and terminating at the discharge edge. The back region includes port means having a forward end through which coating material to be atomized is supplied to the interior. The back region further includes an intermediate portion between the forward end and the side region and oriented axially further away from the discharge edge than the forward end is axially from the discharge edge.

BRIEF DESCRIPTION OF THE DRAWINGS

The detailed description particularly refers to the accompanying figures in which.

DETAILED DESCRIPTION OF THE DRAWINGS

Figure 1:
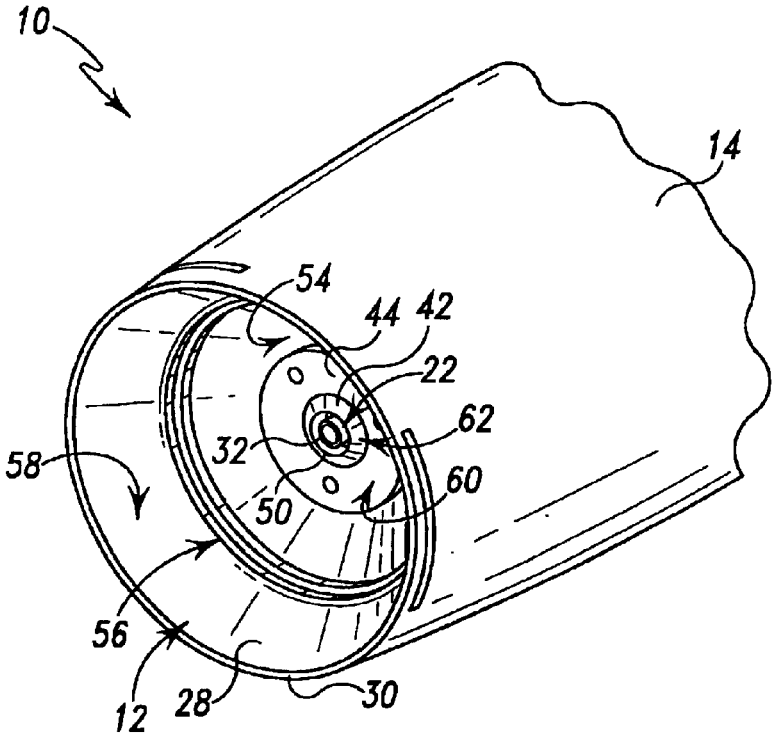
FIG. 1 illustrates a perspective view of a forward end of a rotary atomizer showing a bell cup in accordance with the present disclosure oriented at a forward opening of a cover that shrouds components of the atomizer that are situated behind the bell cup.
Figure 2:
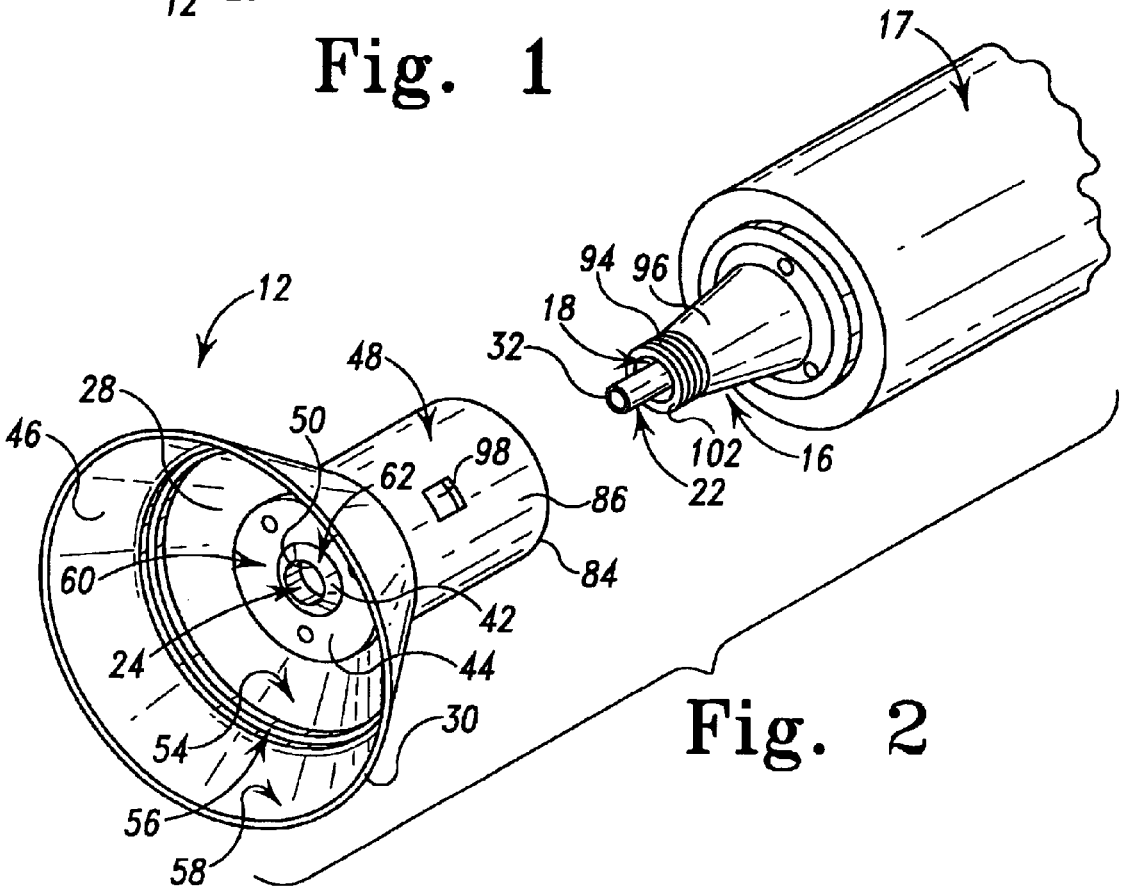
FIG. 2 illustrates an exploded perspective view of the forward end of the rotary atomizer of FIG. 1, without the cover, showing the bell cup removed from the output shaft of the rotary atomizer and showing a feed tube extending from a longitudinal passageway provided in the shaft.
Figure 3:
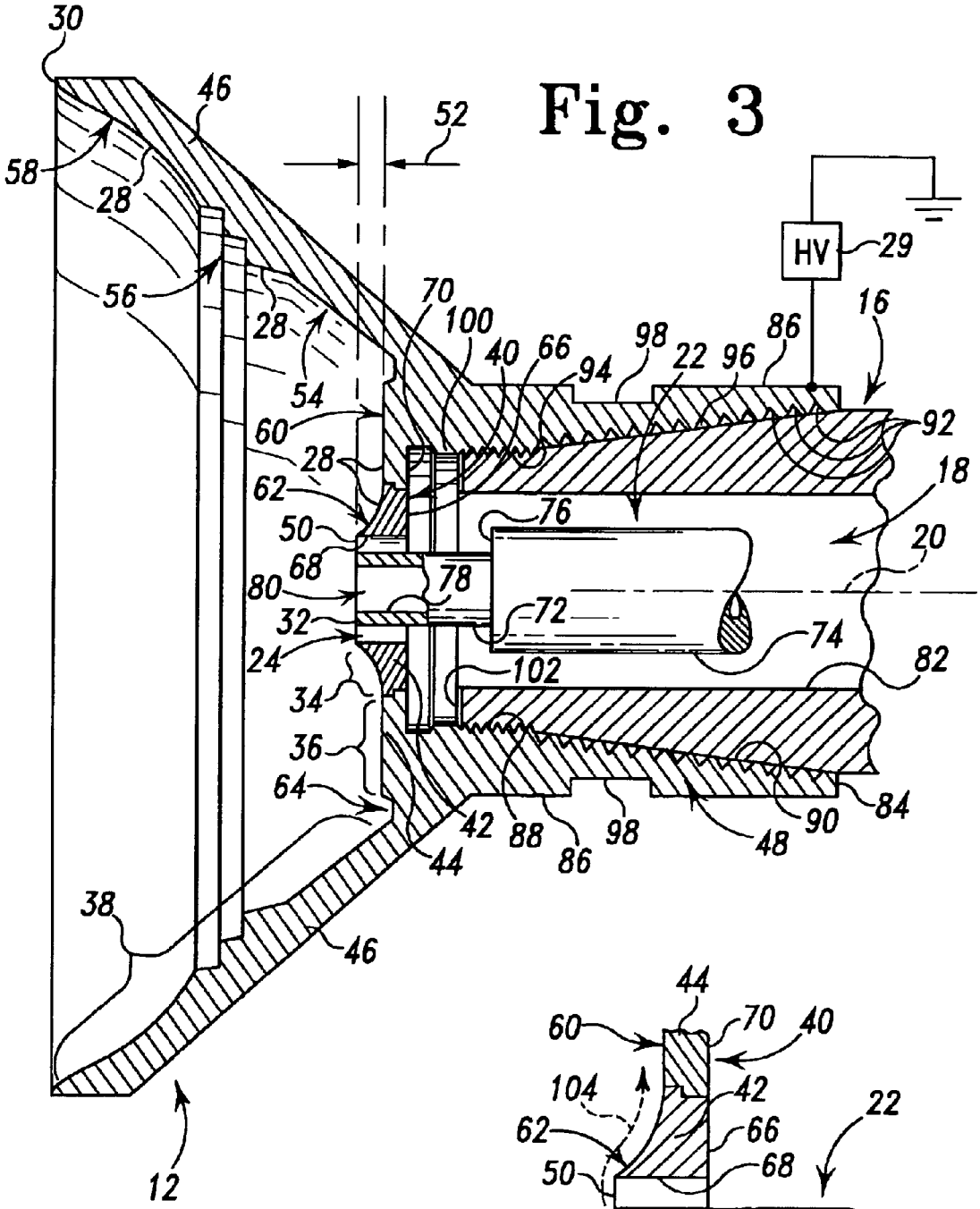
FIG. 3 illustrates a fragmentary partial sectional view through the axis of the rotary atomizer of FIG. 1, showing the bell cup mounted on a forward end of the shaft, a forward end of the feed tube extending into a passageway through the center of the bell cup.

Referring to FIG. 1, a forward end of a rotary atomizer 10 includes a bell cup 12 that is oriented adjacent a forward opening of a shroud 14 of atomizer 10 as illustrated in FIG. 1. (It should be noted that the bell cup 12 illustrated in the drawings is illustrated without its splash plate, in order to simplify the drawings and illustrate the invention more clearly.) Shroud 14 covers many of the components of atomizer 10 which are situated in the region adjacent the discharge edge of the bell cup 12. Atomizer 10 further includes a rotator (not shown), typically a compressed air turbine, having an output shaft 16. A passageway 18 extends longitudinally through shaft 16. Atomizer 10 further includes a feed tube 22 which extends longitudinally within passageway 18 and from passageway 18 as best illustrated in FIGS. 2 and 3. The open front end 32 of feed tube 22 is oriented in a passageway 24 in bell cup 12. The clearance between the front end 32 of feed tube 22 and passageway 24 must be sufficiently narrow to minimize the likelihood that liquid coating material 26 will wick back along the clearance. The necessary clearance will depend on parameters such as, for example, the surface tension of the material 26.

Figure 4:
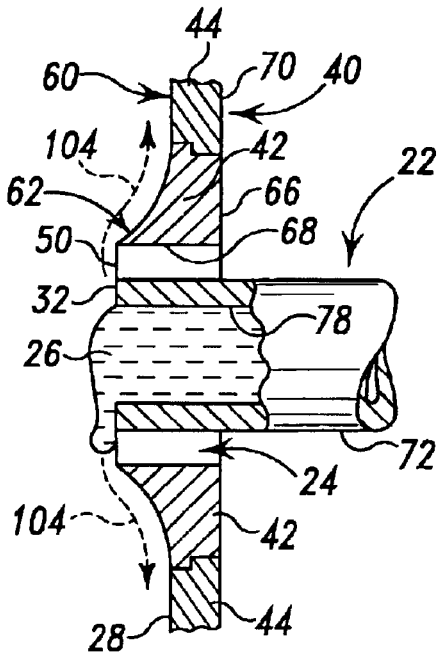
FIG. 4 illustrates an enlarged fragmentary sectional view of the forward end of the feed tube and a portion of the bell cup as illustrated in FIG. 3 showing coating material being discharged from a discharge end of the feed tube which is substantially coplanar with the surrounding region of the bell cup.

Referring particularly to FIG. 4, liquid coating material 26 fed to the rear end of feed tube 22 flows out of the open front end 32 of feed tube 22 onto an inner surface 28 of bell cup 12. As the shaft 16 on which bell cup 12 is mounted rotates, the material 26 is forced radially outward and forward along the inner surface 28 of the bell cup 12, forming a film. The material 26 in the film flows across inner surface 28 from the front end of passageway 24 toward a discharge edge 30 at the front end of bell cup 12. A high-magnitude electrostatic potential source 29, illustrated diagrammatically in FIG. 3, coupled to bell cup 12 charges the material 26 in the film as it flows across surface 28. At discharge edge 30 of bell cup 12, material 26 is discharged as an electrostatically charged mist of coating material particles. The charged particles are attracted toward, for example, grounded objects to be coated. U.S. Pat. Nos. 6,230,993; 6,076,751; 5,662,278; 5,622,563, 5,433,387; and 4,943,005 further describe this process.

According to this invention, certain features of the shape and materials from which the inner surface 28 of bell cup is fabricated, and the orientation of feed tube 22 cooperate to reduce the buildup of coating material around the discharge opening 32 of feed tube 22. Inner surface 28 is metal, illustratively a single metal, and illustratively titanium or aluminum. As best illustrated in FIG. 3, inner surface 28 includes a first region 34 that extends radially outwardly and rearwardly from the front end of passageway 24, a second region 36 that extends generally radially outwardly from first region 34, and a third region 38 that extends generally radially outwardly and forwardly from second region 36 to discharge edge 30. Bell cup 12 includes a back wall 40 including a portion 42 that provides first region 34 of inner surface 28 and an intermediate portion 44 that provides second region 36 of inner surface 28. Bell cup 12 also has a sidewall or region 46 extending forwardly from back wall 40 and radially outwardly from the axis 20 of rotation, and a coaxial coupling collar 48 extending rearwardly from back wall 40. Sidewall 46 terminates at discharge edge 30.

Figure 5:
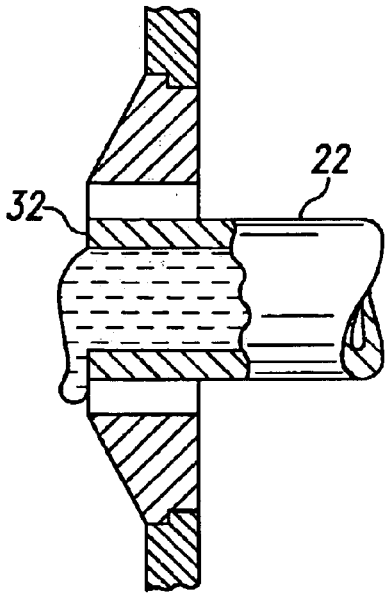
FIG. 5 illustrates an enlarged fragmentary sectional view of an another embodiment of a portion of the bell cup; and, FIG. 6 illustrates an enlarged fragmentary sectional view of an another embodiment of a portion of the bell cup.
Figure 6:
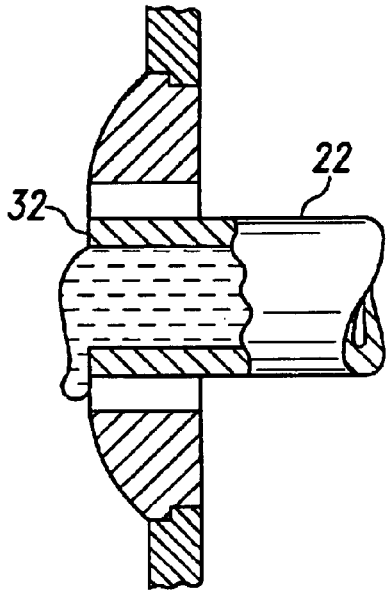

Discharge end 32 of feed tube 22 is substantially coplanar with a forwardly projecting end 50 of first region 34 as best illustrated in FIGS. 3 and 4. Illustratively, the discharge end 32 of feed tube 22 terminates within about 020" (about 0.5 mm or so) forward of the forwardly projecting end 50 of first region 34 to flush with the forward end 50, with best performance appearing to be achieved when the discharge end 32 terminates about 0.005" (about 0.1 mm or so) forward of end 50 to flush with end 50. The radially extending portion of surface 28 associated with second region 36 is substantially planar, as illustrated at 60, and is offset rearwardly from forward end 50 by a distance 52 as best illustrated in FIG. 3. The portion of surface 28 associated with first region 34 is somewhat frustoconical, as illustrated at 62. The phrase "somewhat frustoconical" is meant to include shapes that are frustoconical as illustrated in FIG. 5, forwardly concave as illustrated in FIGS. 1–4, and forwardly convex as illustrated in FIG. 6. As best illustrated in FIGS. 3 and 4, the somewhat frustoconical portion of surface 28 associated with first region 34 is slightly concave and blends smoothly into the portion of surface 28 associated with second region 36. Although portion 42 is illustrated in FIGS. 3 and 4 as being a separate insert that is press fitted into intermediate portion 44 of back wall 40, it is within the scope of this disclosure for back wall 40 to be formed so that portion 42 is integral with intermediate portion 44. It should also be understood that bell cup 12 need not be made from a single metal or even completely from metal, as long as surface 28 is a metal surface.

The portion of illustrative surface 28 associated with third region 38 includes a substantially frustoconical surface 54, a stepped region 56 axially forward of, and radially outward from, surface 54, and a somewhat frustoconical surface 58 axially forward of region 56 as illustrated in FIGS. 1–3. In the illustrative embodiment, somewhat frustoconical surface 58 is slightly forwardly concave. A forwardly opening, circular groove 64 is formed between surface 60 of region 36 and surface 54 of region 38 as best illustrated in FIG. 3. In other embodiments, groove 64 can be omitted. In such embodiments, surface 60 extends radially outwardly to, and blends smoothly into, surface 54. Although intermediate portion 44 of wall 40 is illustrated as being formed integrally with sidewall 46, it is also within the scope of this disclosure for intermediate portion 44 to be formed separately from wall 46 and attached thereto.

Portion 42 has a generally planar back surface 66. Passageway 24 is generally right circular cylindrical in configuration, as illustrated at 68, and extends through portion 42 between back surface 66 and front end 50. Intermediate portion 44 has a back surface 70 that, in the illustrative embodiment, is coplanar with surface 66 of portion 42. Feed tube 22 has a first outer, right circular cylindrical surface 72, a second outer, right circular cylindrical surface 74, and a generally radially extending shoulder surface 76 joining surfaces 72, 74 as best illustrated in FIG. 3. Feed tube 22 further has an inner, right circular cylindrical bore 78 defining a passageway 80 through feed tube 22. Shaft 16 has an inner, right circular cylindrical surface 82 defining passageway 18. An annular space is defined between surfaces 68, 72. Similarly, an annular space is defined between surfaces 74, 82. Surfaces 68, 72, 74, 78, 82 are coaxial with axis 20. Feed tube 22 is stationary, while shaft 16 and bell cup 12 rotate during coating operations.

Coupling collar 48 of bell cup 12 has an outer, generally right circular cylindrical surface 86 that extends rearwardly from sidewall 46 to a rear end 84 as best illustrated in FIGS. 2 and 3. Coupling collar 48 further includes a tapered bore 90 that extends forward from rear end 84, and terminates in a threaded section 88, as best illustrated in FIG. 3. Tapered bore 90 is formed to include a plurality of circular grooves 92. Shaft 16 has a complementary threaded end 94 and tapered outer surface 96 extending rearwardly from front region 94 as best illustrated in FIG. 2. In the illustrative embodiment, the diameter of outer cylindrical surface 86 of coupling collar 48 is smaller than the diameter of discharge edge 30.

Coupling collar 48 is formed to include a pair of generally diametrically opposed flats 98 adapted to be engaged by a tool, such as a wrench, during mounting of bell cup 12 on, and removal of bell cup 12 from, shaft 16. To mount bell cup 12 on shaft 16, shaft 16 is blocked from rotating about axis 20 while bell cup 12 is rotated relative to shaft 16 so that threaded bore 88 of coupling collar 48 threads onto front region 94 of shaft 16. Bell cup 12 has an annular ridge 100 just forward of threaded bore 88 that engages a front end 102 of shaft 16 to orient bell cup 12 properly on shaft 16 so that forward end 32 of portion 42 is substantially coplanar with discharge end 32 of feed tube 22. As bell cup 12 is threaded onto shaft 16, any debris on front region 94 and tapered surface 96 can be accommodated in grooves 92.

As mentioned above, liquid coating material 26 is fed from feed tube 22 onto inner surface 28 of rotating bell cup 12 and, owing to the rotation of bell cup 12, forms a film that flows across inner surface 28 to edge 30, from which electrostatically charged particles of coating material are discharged. The flow of coating material 26 as it exits discharge end 32 of feed tube 22 is illustrated diagrammatically in FIG. 4 with dashed arrows 104. When coating material 26 first exits feed tube 22, it flows substantially radially outwardly across discharge end 32 and across the space defined between cylindrical surface 72 of feed tube 22 and cylindrical surface 68 of portion 42. The coating material 26 then flows radially outwardly and axially rearwardly along surface 62 of portion 42 toward surface 60 of intermediate portion 44. The coating material 26 flows radially outwardly along surface 60 and then flows radially outwardly and axially forwardly along surfaces 54, 56, 58.

As previously noted, tests of the rotary atomizer 10 having illustrative bell cup 12 and feed tube 22 demonstrated that coating material buildup on feed tube 22 is reduced as compared to prior art bell cup and feed tube configurations and arrangements.

During a first test, the bell cup 12 was rotated at about 40,000 revolutions per minute (r.p.m.) and coating material was fed through the feed tube 22 at about 260 cubic centimeters per minute ($cc^3$/min). During a second test, the bell cup 12 was rotated at about 40,000 r.p.m. and the coating material was fed through the feed tube at a rate of about 500 $cc^3$/min. The coating material 26 used during the tests was E. I. DuPont de Nemours 694-AE590 bright white GW7. In addition, the coating material 26 feed was triggered on for fifteen seconds, then off for five seconds, repeated throughout the tests, each of which lasted between about five and about ten minutes. Axis 20 was maintained horizontal in each test. Tests of several prior art bell cups and feed tubes under the same test conditions resulted in more coating material buildup on the ends of the respective feed tubes.

Although a certain illustrative embodiment has been described in detail above, variations and modifications exist within the scope and spirit of this disclosure as described and as defined in the following claims.

What is claimed is:

1. A rotary atomizer including a shaft rotatable about an axis, the shaft having a passageway extending longitudinally along the shaft, a bell cup coupled to the shaft, the bell cup having an interior defined by an axially rearward metal back region, an axially forward metal discharge edge, and a metal side region extending from the back region toward the discharge edge and terminating at the discharge edge, the back region including a port having a forward end, the back region including an intermediate portion between the forward end and the side region, the intermediate portion being oriented axially further away from the discharge edge than the forward end is axially from the discharge edge, and a feed tube oriented in the passageway and having a discharge end through which liquid coating material is discharged.

2. The apparatus of claim 1 wherein the back region, discharge edge and side region are all constructed from the same metal.

3. The apparatus of claim 1 wherein the metal back region, metal discharge edge and metal side region are all aluminum.

4. The apparatus of claim 1 wherein the metal back region, metal discharge edge and metal side region are all titanium.

5. The apparatus of claim 1 wherein the discharge end is oriented axially forward of the intermediate portion.

6. The apparatus of claim 5 wherein the discharge end is substantially coplanar with the forward end.

7. The apparatus of claim 5 wherein the port includes a somewhat frustoconical surface having a base oriented adjacent the intermediate portion.

8. The apparatus of claim 7 wherein the discharge end is substantially coplanar with the forward end.

9. The apparatus of claim 1 further including a high-magnitude potential supply coupled to the rotary atomizer for providing electrical charge to coating material discharged from the discharge edge.

10. The apparatus of claim 1 wherein the port includes a somewhat frustoconical surface having a base oriented adjacent the intermediate portion.

11. The apparatus of claim 1 wherein the discharge end is substantially coplanar with the forward end.

12. A bell cup for attachment to the shaft of a rotator to be rotated by the rotator to atomize coating material supplied to an interior of the bell cup, the bell cup interior defined by an axially rearward metal back region, an axially forward metal discharge edge, and a metal side region extending from the back region toward the discharge edge and terminating at the discharge edge, the back region including a port having a forward end through which coating material to be atomized is supplied to the interior, the back region including an intermediate portion between the forward end and the side region, the intermediate portion being oriented axially further away from the discharge edge than the forward end is axially from the discharge edge.

13. The apparatus of claim 12 wherein the back region, discharge edge and side region are all constricted from the same metal.

14. The apparatus of claim 12 wherein the metal back region, metal discharge edge and metal side region are all aluminum.

15. The apparatus of claim 12 wherein the metal back region, metal discharge edge and metal side region are titanium.

16. The apparatus of claim 12 further including a feed tube for supplying coating material to the interior, the feed tube having a discharge end substantially coplanar with the forward end, liquid coating material being discharged through the discharge end.

17. A method of atomizing coating material, the method including providing a bell cup having an interior defined by an axially rearward metal back region, an axially forward metal discharge edge, and a metal side region extending from the back region toward the discharge edge and terminating at the discharge edge, the back region including a port having a forward end, the back region including an intermediate portion between the forward end and the side region, the intermediate portion being oriented axially further away from the discharge edge than the forward end is axially from the discharge edge, rotating the bell cup about a rotational axis, and feeding liquid coating material to the port.

18. The method of claim 17 wherein providing a bell cup having an interior defined by an axially rearward metal back region, an axially forward metal discharge edge, and a metal side region includes providing a bell cup having an interior defined by an axially rearward back region, an axially forward discharge edge, and a side region, all of the same metal.

19. The method of claim 17 wherein providing a bell cup having an interior defined by an axially rearward metal back region, an axially forward metal discharge edge, and a metal side region includes providing a bell cup having an interior defined by an axially rearward aluminum back region, an axially forward aluminum discharge edge, and an aluminum side region.

20. The method of claim 17 wherein providing a bell cup having an interior defined by an axially rearward metal back region, an axially forward metal discharge edge, and a metal side region includes providing a bell cup having an interior defined by an axially rearward titaninum back region, an axially forward titaninum discharge edge, and a titaninum side region.

21. The method of claim 17 wherein feeding liquid coating material to the port includes feeding liquid coating material to the forward end.

22. The method of claim 17 wherein providing a back region including a port having a forward end includes providing a bell cup having a somewhat frustoconical surface having a base oriented adjacent the intermediate portion.

23. The method of claim 17 further including providing electrical charge to coating material discharged from the discharge edge.

24. A method of atomizing coating material, the method including providing a rotator having an output shaft rotatable about an axis, providing a passageway extending longitudinally along the shaft, coupling a bell cup to the shaft, defining in the bell cup an interior having an axially rearward metal back region including a port having a forward end, an axially forward metal discharge edge, and a metal side region extending from the back region toward the discharge edge and terminating at the discharge edge, also providing on the back region a metal intermediate portion between the forward end and the side region and oriented axially further away from the discharge edge than the forward end is axially from the discharge edge, and providing in the passageway a feed tube, terminating the feed tube at a discharge end substantially coplanar with the forward end, and discharging liquid coating material through the discharge end.

25. The method of claim 24 wherein defining in the bell cup an interior having an axially rearward metal back region, an axially forward metal discharge edge, and a metal side region, and providing on the back region a metal intermediate portion between the forward end and the side region includes defining in the bell cup an interior having an axially rearward back region, an axially forward discharge edge, and a side region, and providing on the back region an intermediate portion, all of the same metal.

26. The method of claim 24 wherein defining in the bell cup an interior having an axially rearward metal back region, an axially forward metal discharge edge, and a metal side region, and providing on the back region a metal intermediate portion between the forward end and the side region includes defining in the bell cup an interior having an axially rearward aluminum back region, an axially forward aluminum discharge edge, and an aluminum side region, and providing on the back region an aluminum intermediate portion.

27. The method of claim 24 wherein defining in the bell cup an interior having an axially rearward metal back region, an axially forward metal discharge edge, and a metal side region, and providing on the back region a metal intermediate portion between the forward end and the side region includes defining in the bell cup an interior having an axially rearward titaninum back region, an axially forward titaninum discharge edge, and a titaninum side region, and providing on the back region a titaninum intermediate portion.

28. The method of claim 24 wherein defining in the bell cup an interior having an axially rearward back region including a port having a forward end and an intermediate portion between the forward end and the side region and oriented axially further away from the discharge edge than the forward end includes providing a somewhat frustoconical surface having a base oriented adjacent the intermediate portion.

29. The method of claim 24 further including providing electrical charge to coating material discharged from the discharge edge.

30. A method of dispensing coating material including providing a bell cup having an axis of rotation, defining in the bell cup an interior including an axially rearward metal back region, an axially forward metal discharge edge, and a metal side region extending from the back region toward the discharge edge and terminating at the discharge edge, including in the back region a port having a forward end through which coating material to be atomized is supplied to the interior, including in the back region a metal intermediate portion between the forward end and the side region and oriented axially further away from the discharge edge than the forward end is axially from the discharge edge, rotating the bell cup about its axis, and feeding coating material to the forward end.

31. The method of claim 30 wherein defining in the bell cup a metal back region, a metal discharge edge, and a metal side region and including in the back region a metal intermediate portion includes defining in the bell cup a back region, a discharge edge, and a side region and including in the back region an intermediate portion, all of the same metal.

32. The method of claim 30 wherein defining in the bell cup a metal back region, a metal discharge edge, and a metal side region and including in the back region a metal intermediate portion includes defining in the bell cup an aluminum back region, an aluminum discharge edge, and an aluminum side region and including in the back region an aluminum intermediate portion.

33. The method of claim 30 wherein defining in the bell cup a metal back region, a metal discharge edge, and a metal side region and including in the back region a metal intermediate portion includes defining in the bell cup a titaninum back region, a titaninum discharge edge, and a titaninum side region and including in the back region a titaninum intermediate portion.

34. The method of claim 30 wherein feeding coating material to the forward end includes feeding coating material through a feed tube having a discharge end substantially coplanar with the forward end, liquid coating material being discharged through the discharge end.

35. The method of claim 30 further including providing electrical charge to coating material discharged from the discharge edge.

36. Apparatus for atomizing coating material, the apparatus including bell cup means for defining an interior including an axially rearward metal back region, an axially forward metal discharge edge, and a metal side region extending from the back region toward the discharge edge and terminating at the discharge edge, the back region including a port having a forward end, the back region including a metal intermediate portion between the forward end and the side region, the intermediate portion being oriented axially further away from the discharge edge than the forward end is axially from the discharge edge, means for rotating the bell cup means about a rotational axis, and means for feeding liquid coating material to the port.

37. Apparatus for atomizing coating material, the apparatus including bell cup means for defining an interior having an axially rearward metal back region including a port having a forward end, an axially forward metal discharge edge, a metal side region extending from the back region toward the discharge edge and terminating at the discharge edge, and a metal intermediate portion between the forward end and the side region and oriented axially further away from the discharge edge than the forward end is axially from the discharge edge, means for rotating the bell cup means about its axis, the means for rotating the bell cup means having an output shaft rotatable about an axis, the output shaft having a passageway extending longitudinally along the output shaft, means for coupling the bell cup means to the output shaft, and means in the passageway for supplying coating material to the interior, the means for supplying coating material terminating at a discharge end substantially coplanar with the forward end.

38. Apparatus for dispensing coating material including bell cup means defining an axis of rotation and an interior including an axially rearward metal back region, an axially forward metal discharge edge, and a metal side region extending from the back region toward the discharge edge and terminating at the discharge edge, the back region including port means having a forward end through which coating material to be atomized is supplied to the interior, the back region further including an intermediate portion between the forward end and the side region and oriented axially further away from the discharge edge than the forward end is axially from the discharge edge, means for rotating the bell cup about its axis, and means for feeding coating material to the forward end.

* * * * *